US006012689A

United States Patent [19]

Sisca

[11] Patent Number: 6,012,689

[45] Date of Patent: Jan. 11, 2000

[54] SAFETY LADDER ACCESSORY CONTAINER

[75] Inventor: Frank J. Sisca, 15 Buttercup La., San Carlos, Calif. 94070

[73] Assignee: Frank J. Sisca, San Carlos, Calif.

[21] Appl. No.: 08/966,235

[22] Filed: Nov. 7, 1997

[51] Int. Cl.[7] ..... E06C 7/14; A47G 29/02

[52] U.S. Cl. ..... 248/210; 182/129; 248/238

[58] Field of Search ..... 248/210, 238; 182/129

[56] References Cited

U.S. PATENT DOCUMENTS

| | | | |
|---|---|---|---|
| 3,899,045 | 8/1975 | Geisel et al. | 182/121 |
| 4,356,854 | 11/1982 | McGee | 150/12 |
| 4,480,810 | 11/1984 | Hall . | |
| 5,123,620 | 6/1992 | Bourne . | |
| 5,181,583 | 1/1993 | Platt | 182/129 |
| 5,259,480 | 11/1993 | Bartnicki et al. . | |
| 5,333,823 | 8/1994 | Joseph | 248/146 |
| 5,584,357 | 12/1996 | Gugel et al. . | |
| 5,603,405 | 2/1997 | Smith | 206/373 |
| 5,636,817 | 6/1997 | Beachy | 248/210 |
| 5,638,915 | 6/1997 | Hardy | 182/129 |
| 5,647,453 | 7/1997 | Cassells | 182/129 |
| 5,673,885 | 10/1997 | Pham | 248/210 |
| 5,749,437 | 5/1998 | Weller | 182/129 |
| 5,782,314 | 7/1998 | Zeitler | 248/210 X |
| 5,813,530 | 9/1998 | Kornblatt | 206/373 |
| 5,901,998 | 5/1999 | Gallo | 294/143 |

*Primary Examiner*—Derek J. Berger
*Assistant Examiner*—Michael Nornberg
*Attorney, Agent, or Firm*—Arnold White & Durkee

[57] ABSTRACT

A combination accessory container and safety device, or safety ladder accessory container, is designed to be mounted over the top of a ladder and in particular of an A-frame ladder. The safety ladder accessory container comprises a domed top and at least one side container. The domed top sits on the top platform of a ladder and can be mounted to the top platform. The safety ladder accessory container can also comprise a front wall, a back wall and a front platform. The front wall and back wall each extend generally downwardly from the domed top and are either fixedly connected to or integrally formed with the domed top. The front platform extends generally horizontally from the front wall, rests on a step of the ladder, and is fixedly attached or integrally formed with the front wall. Each side container can be fixedly attached to or integrally formed with either the domed top or with the front wall and back wall. Alternatively, there can be a right side wall and a left side wall, each extending generally downwardly from the domed top. The right and left side walls can be fixedly connected or integrally formed with the front and back walls and the domed top. A right side container and a left side container can then be fixedly attached or integrally formed with the right wall and left wall respectively.

15 Claims, 2 Drawing Sheets

SAFETY LADDER ACCESSORY CONTAINER

FIELD OF THE INVENTION

This invention relates to a combination accessory container and safety device for a ladder, and more particularly to an accessory container for a ladder that is designed to be mounted over the top of an A-frame ladder and to prevent a person from stepping on the top platform of the ladder.

BACKGROUND OF THE INVENTION

A-frame ladders are popular for workers who need to reach relatively high locations above the ground or floor level for performing construction and maintenance chores, both on a work site and in the home. It is often desirable while the worker is on the ladder for the worker to have access to tools, parts and work supplies that are needed during the performance of his duties or chores. It is often desirable while the worker is on the ladder to have a structure that prevents the worker from climbing onto the very top platform of the A-frame ladder, which is extremely dangerous and prohibited by many safety codes, or from placing tools and supplies on the top platform, which is dangerous to anyone standing below the ladder.

Many devices have been invented over the years that attach to ladders to hold tools, parts and work supplies so that they are easily accessible to the worker while he is standing on or otherwise using the ladder. U.S. Pat. Nos. 4,480,810, 5,123,620, 5,259,480 and 5,584,357 all describe accessory holders for ladders. In U.S. Pat. No. 4,480,810, the accessory holder attaches to a rung of the ladder and in U.S. Pat. No. 4,123,620, the accessory holder attaches to the top platform of a ladder, but does not prevent a user from stepping on the top platform. Similarly, in U.S. Pat. No. 5,584,357, the accessory holder attaches to the top platform, but is raised high above the top step so that a user could still climb to the top platform. U.S. Pat. No. 5,259,480 describes an accessory holder that directly sits on the top platform and expands the work area of the top platform for storing and attaching tools. It does not, however, completely prevent a user from climbing to the top platform and does not provide deep storage containers for tools and accessories.

An advantage of the present invention is that it provides an improved accessory container suitable for use with an A-frame ladder that fits over the top of the A-frame ladder and prevents a person from climbing to the top platform of the ladder or from placing tools and accessories on the top platform.

SUMMARY OF THE INVENTION

A combination accessory container and safety device, or safety ladder accessory container, is designed to be placed over the top platform of a ladder, and in particular of an A-frame ladder. The safety ladder accessory container has a domed top that sits on the top platform of a ladder to prevent the user of the ladder from stepping onto the top platform. The domed top can also be mounted to the top platform. Furthermore, the domed top can define a plurality of holes to receive connectors to mount the domed top to the top platform of the ladder. The front wall, back wall, left and right side walls, side containers, and domed top can be constructed of molded poly-styrene. Extending generally downwardly from the front side of the domed top there can be a front wall. Extending generally downwardly from the back side of the domed top there can be a back wall. Additionally, extending generally horizontally from the front wall there can be a front platform. The front platform rests on a step of the ladder. The platform can be formed integrally with the front wall or fixedly connected. Similarly, the front wall and back wall can each be integrally connected with the domed top or fixedly connected.

On each side of the safety ladder accessory container there can be a side container. Each side container can be fixedly connected to the front wall and back wall. Each side container can also be integral with left and right side walls, which are fixedly attached or formed integrally with the front wall, front platform, and back wall and which extend generally downwardly from the domed top. Alternatively, each side container can be fixedly connected to or integral with the domed top without including a front wall, back wall, side walls or a front platform. Each side container is open at its top to permit placing tools and accessories in the container while working on the ladder. The containers encourage a ladder's user to place tools and accessories in the containers rather than on other steps, which could create a hazard to anyone standing below the ladder. The front wall, back wall, left and right side walls, side containers, and domed top can be constructed of molded poly-styrene.

BRIEF DESCRIPTION OF THE DRAWINGS

The advantages, features and design of the invention will become apparent from the following detailed description of the invention and the accompany drawings in which like reference refer to like elements and in which.

DETAILED DESCRIPTION OF THE INVENTION

The combination accessory container and safety device, or safety ladder accessory container, for a ladder of the present invention can be placed over the top platform of a ladder, and in particular of an A-frame ladder. The safety ladder accessory container has a domed top that sits on the top platform of a ladder to prevent the user of the ladder from stepping onto the top platform, which violates safety rules. Additionally, the domed top prevents a ladder's user from placing tools on the top platform, which could create a hazard to anyone below the ladder. Extending generally downwardly from the domed top there can be a front wall and a back wall. Extending generally horizontally from the front wall there can be a front platform to rest on a step of the ladder. On each side of the safety ladder accessory container there can be a side container, either connected to the front and back walls, or to side walls that can extend generally downwardly from the domed top. Alternatively, the side containers can be connected to the domed top without including a front wall, back wall, side walls or front platform. Each side container is open at its top to permit placing tools and accessories in the container while working on the ladder. The containers encourage a ladder's user to place tools and accessories in the containers rather than on other steps, which could create a hazard to anyone standing below the ladder.

Figure 1:
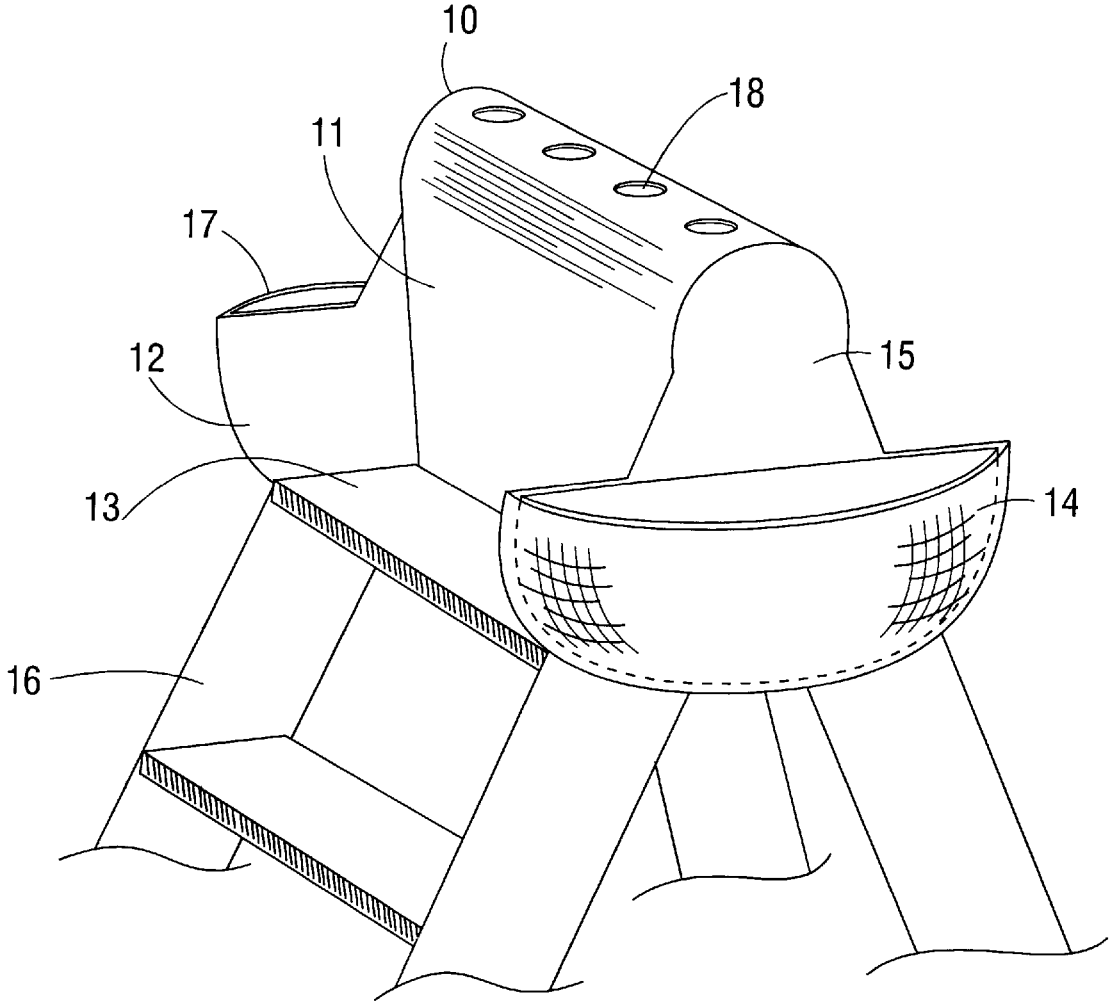
FIG. 1 is a perspective view of a preferred embodiment of the safety ladder accessory holder of this invention placed over the top platform of an A-frame ladder.
Figure 2:
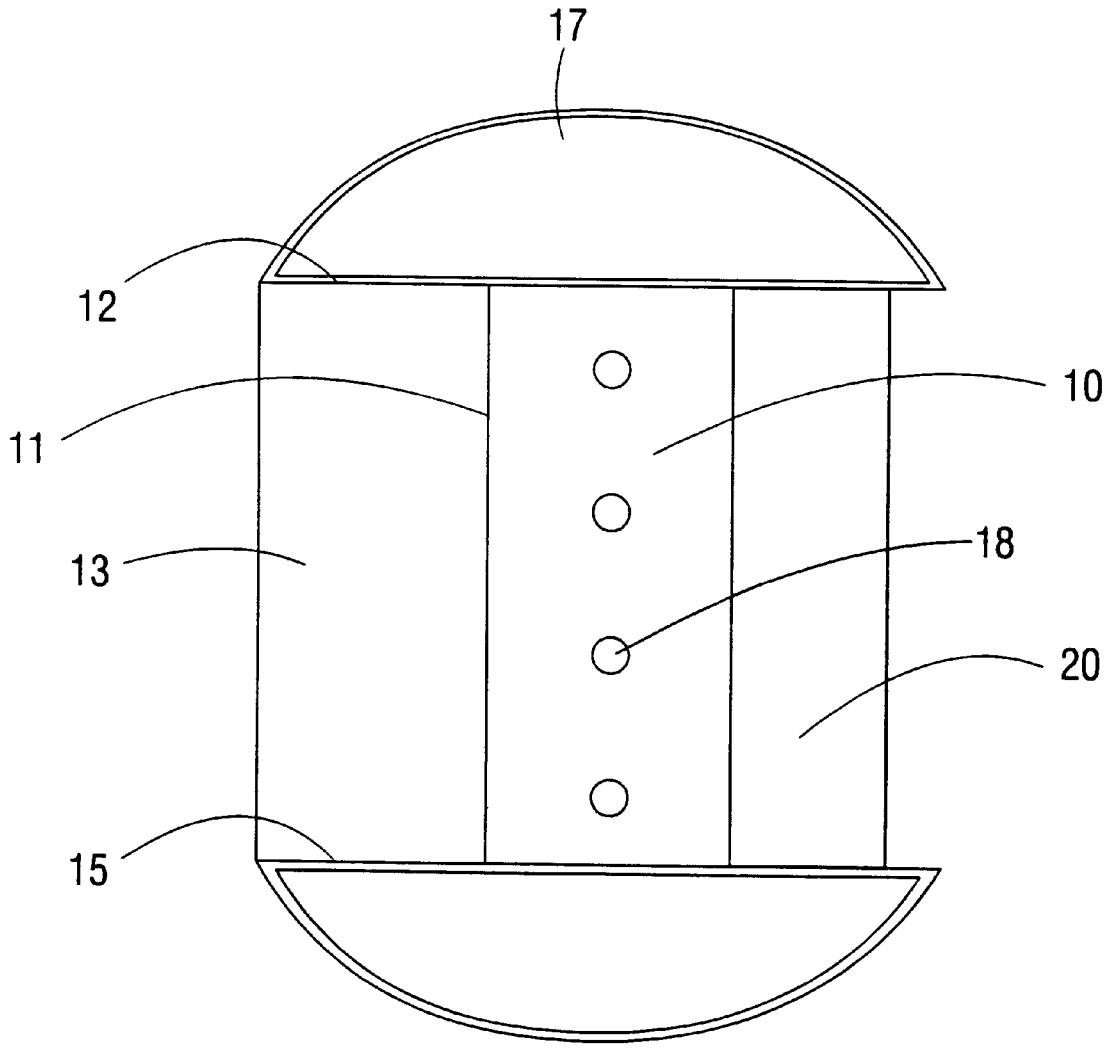
FIG. 2 is a top view of a preferred embodiment of the safety ladder accessory holder of this invention.

Referring to FIGS. 1 and 2, the safety ladder accessory container in a preferred embodiment of the present invention comprises a domed top 10 and one or more side containers 14 and 17. Additionally, the safety ladder accessory container can comprise a front wall 11, a back wall 20, a front platform 13, a right side wall 14 and a left side wall 12. All of the elements in a preferred embodiment are made of molded poly-styrene. Alternatively, any of the elements could comprise any type of plastic or metal.

The domed top 10 in a preferred embodiment fits securely over the top platform of a ladder 16. It can be mounted to the ladder 16 through the top or sides of the domed top 10 with connectors, such as bolts, screws or other hardware. In a preferred embodiment, the domed top 10 extends from a vertical plane on one side to a vertical plane on the opposite side through a semicircular curve, as shown in FIG. 1. The domed top can assume any geometric shape, as long as it prohibits the ladder's user from stepping on the top platform of the ladder or from using the top platform or dome as a place to put tools or accessories. For example, a sharp triangular dome, a pyramid, or a hexagonal-shaped dome could be used. The dome shown in FIG. 1 is preferred because it creates no dangerous sharp edges.

Extending generally downwardly from the domed top 10 on its front side there can be a front wall 11. The front wall 11 can be perfectly vertical in a preferred embodiment, or it can be angled. Additionally, the front wall 11 can be solid or it can have at least one opening to allow a ladder user's foot or any object to pass therethrough. In a preferred embodiment, the front wall 11 is solid and is formed integrally with the domed top 10. Alternatively, it can be fixedly connected with generally known hardware, such as hinges, bolts or screws.

Extending generally downwardly from the domed top 10 on its back side there can be a back wall 20. The back wall 20 can be perfectly vertical in a preferred embodiment, or it can be angled. Additionally, the back wall 20 can be solid or it can have at least one opening to permit objects to pass therethrough. In a preferred embodiment, the back wall 20 is solid and formed integrally with the domed top 10. Alternatively, it can be fixedly connected with generally known hardware, such as hinges, bolts or screws.

Attached to at least one side of the safety ladder accessory container, there can be an accessory container. In FIGS. 1 and 2, two accessory containers 14 and 17 are shown. On the right side of the safety ladder accessory container is a right container 14. On the left side is a left container 17. Each container is either integrally connected or fixedly attached to the domed top 10 of the safety ladder accessory container. Alternatively, it can be integrally connected or fixedly attached to the front wall 11 and back wall 20 either instead of connecting to the domed top 10 or in addition to connecting to the domed top 10. The containers can be any shape that will hold tools and other accessories. A preferred embodiment is a semi-circular pouch, as shown in FIGS. 1 and 2. Alternatively, the containers can be shaped like a box or a trough.

Extending generally horizontally from the front wall 11, in an alternative embodiment, there can be a front platform 13. The front platform 13 rests on a step of the ladder. This provides stability to the safety ladder accessory container when the user steps on the front platform 13. In a preferred embodiment, the front platform 13 is formed integrally with the front wall 11. Alternatively, it can be fixedly connected with generally known hardware, such as hinges, bolts or screws.

In another embodiment, as shown in FIGS. 1 and 2, there can also be a right side wall 15 and a left side wall 12. Each of the side walls 12 and 15 can extend from the highest point of the domed top generally downwardly and from the front wall 11 to the back wall 20. The side walls 12 and 15 can be solid or have at least one hole therethrough. In a preferred embodiment, the side walls 12 and 15 are solid and are formed integrally with the domed top 10, the front wall 11 and the back wall 20. The side walls 12 and 15 could also be fixedly attached to the domed top 10, front wall 11 or back wall 20 with generally known hardware such as hinges, bolts or screws.

Also in another embodiment, as shown in FIGS. 1 and 2, the right and left side containers 14 and 17 are integrally formed with the right and left side walls 15 and 12. In this embodiment, the containers 14 and 17 need not be attached to the front wall 11 or back wall 20, but rather just extend out from the side walls 12 and 15. Similarly, the containers could be fixedly attached to the side walls 12 and 15 with generally known hardware such as hinges, bolts or screws.

The domed top 10 can be constructed to define a plurality of holes 18 to receive connectors to mount the domed top 10 to a top platform (not shown) of the ladder. The front wall 11, the back wall 20, the left and right side walls 12 and 15, the containers 14 and 17, and the domed top 10 can be constructed of molded poly-styrene.

What is claimed is:

1. A safety ladder accessory container for placement over a ladder having front and back legs both connected to a rectangular-shaped top platform having a length and a width wherein said length is defined by the longer side of the rectangle, the accessory container comprising:

a semi-cylindrically shaped domed top defined by a center axis that is parallel to said length of said top platform, wherein said domed top substantially encloses said top platform, and at least one side compartment to store accessories, said side compartment being connected to said domed top;

wherein said domed top is integrally formed with said side compartment.

2. The safety ladder accessory container of claim 1 further comprising:

a front wall extending generally downwardly from said domed top; and a back wall extending generally downwardly from said domed top.

3. The safety ladder accessory container of claim 2 further comprising a front platform to rest on a ladder step extending generally horizontally from said front wall.

4. The safety ladder accessory container of claim 2 wherein said front wall is formed integrally with said domed top and said back wall is formed integrally with said domed top.

5. The safety ladder accessory container of claim 3 wherein said front wall is formed integrally with said domed top, said back wall is formed integrally with said domed top and said front platform is formed integrally with said front wall.

6. The safety ladder accessory container of claim 4 wherein said side compartment is formed integrally with said front wall and said back wall.

7. The safety ladder accessory container of claim 1 wherein said side compartment comprises a generally semi-circular shape.

8. The safety ladder accessory container of claim 1 wherein said domed top and said side compartment comprise molded poly-styrene.

9. The safety ladder accessory container of claim 1 wherein said domed top defines a plurality of holes to receive connectors to mount said domed top to the top platform of the ladder.

10. The safety ladder accessory container of claim 2 wherein said domed top, said front wall, said back wall and said side compartment comprise molded poly-styrene.

11. A safely ladder accessory container for placement over a ladder having front and back legs both connected to a rectangular-shaped top platform having a length and a width wherein said length is defined by the longer side of the rectangle, the accessory container comprising:

a semi-cylindrically shaped domed top defined by a center axis that is parallel to said length of said top platform, wherein said domed top substantially encloses said top platform;

a left side wall extending downwardly from said domed top;

a right side wall extending downwardly from said domed top;

a left side container connected to said left side wall; and a right side container connected to said right side wall;

wherein said domed top, said right wall, said left wall, said right container, and said left container comprise molded poly-styrene.

12. The safety ladder accessory container of claim 11 wherein said left side container comprises a generally semi-circular shape and wherein said right side container comprises a generally semi-circular shape.

13. The safety ladder accessory container of claim 11 wherein said domed top defines a plurality of holes to receive connectors to mount said domed top to the top platform of the ladder.

14. The safety ladder accessory container of claim 11 wherein said domed top, said front wall, said back wall, said right wall, said left wall, said right container and said left container comprise molded poly-styrene.

15. A safety ladder accessory container for placement over a ladder having front and back legs both connected to a rectangular-shaped top platform having a length and a width wherein said length is defined by the longer side of the rectangle, the accessory container comprising:

a semi-cylindrically shaped domed top defined by a center axis that is parallel to said length of said top platform, wherein said domed top substantially encloses said top platform;

a front wall extending generally downwardly from said domed top;

a back wall extending generally downwardly from said domed top; and a left side wall extending downwardly from said domed top, said left side wall connected to said front wall and said back wall;

a right side wall extending downwardly from said domed top, said right side wall being connected to said front wall and said back wall;

a left side container connected to said left side wall;

a right side container connected to said right side wall; and a front platform to rest on a ladder step extending generally horizontally from and being connected to said front wall;

wherein said front wall is formed integrally with said domed top, said back wall is formed integrally with said domed top, said left side wall is formed integrally with said domed top, said front wall and said back wall, and said right side wall is formed integrally with said domed top, said front wall and said back wall.

* * * * *